US011085138B2

(12) United States Patent
Bae et al.

(10) Patent No.: US 11,085,138 B2
(45) Date of Patent: Aug. 10, 2021

(54) DEVICE FOR HANDLING LAUNDRY, AND CONTROL METHOD THEREOF

(71) Applicant: LG ELECTRONICS INC., Seoul (KR)

(72) Inventors: Yonggyung Bae, Seoul (KR); Woonghyun Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 373 days.

(21) Appl. No.: 16/073,196

(22) PCT Filed: Jan. 26, 2017

(86) PCT No.: PCT/KR2017/000988
§ 371 (c)(1),
(2) Date: Jul. 26, 2018

(87) PCT Pub. No.: WO2017/131486
PCT Pub. Date: Aug. 3, 2017

(65) Prior Publication Data

US 2019/0062976 A1 Feb. 28, 2019

(30) Foreign Application Priority Data

Jan. 27, 2016 (KR) ..... 10-2016-0010213

(51) Int. Cl.
*D06F 35/00* (2006.01)
*D06F 37/22* (2006.01)
(Continued)

(52) U.S. Cl.
CPC ..... *D06F 33/44* (2020.02); *D06F 33/00* (2013.01); *D06F 33/46* (2020.02); *D06F 33/68* (2020.02);
(Continued)

(58) Field of Classification Search
CPC ..... D06F 25/00; D06F 29/00; D06F 29/005; D06F 31/00; D06F 33/00; D06F 33/44;
(Continued)

(56) References Cited

U.S. PATENT DOCUMENTS 4,335,591 A * 6/1982 Gillespie ..... D06F 33/00 68/12.23
7,621,012 B2 * 11/2009 Kim ..... D06F 33/00 8/147
(Continued)

FOREIGN PATENT DOCUMENTS

JP 2014-094074 5/2014
KR 10-2004-0096147 11/2004
(Continued)

OTHER PUBLICATIONS

International Search Report (with English Translation) and Written Opinion dated May 30, 2017 issued in Application No. PCT/KR2017/000988.

*Primary Examiner* — Joseph L. Perrin
(74) *Attorney, Agent, or Firm* — KED & Associates LLP

(57) ABSTRACT

The present invention relates to a device for handling laundry and a control method thereof, wherein the device for handling laundry, equipped with a plurality of washing units that wash independently of one another, sets a washing course in order that, when washing is being carried out by a first washing unit and a second washing unit at the same time, a specific operation is not carried out by the first washing unit and the second washing unit at the same time, the washing course being set by combining the washing courses of the plurality of washing units, and thus, operational delays resulting from simultaneous operation are prevented, vibrations are reduced, momentary increases in power consumption are prevented, protecting the device for
(Continued)

handling laundry and improving energy consumption efficiency.

16 Claims, 9 Drawing Sheets

(51) Int. Cl.

| | |
|---|---|
| ***D06F 37/04*** | (2006.01) |
| ***D06F 39/08*** | (2006.01) |
| ***D06F 39/00*** | (2020.01) |
| ***D06F 33/44*** | (2020.01) |
| ***D06F 33/70*** | (2020.01) |
| ***D06F 33/72*** | (2020.01) |
| ***D06F 33/68*** | (2020.01) |
| ***D06F 33/46*** | (2020.01) |
| ***D06F 33/00*** | (2020.01) |
| *D06F 37/40* | (2006.01) |
| *D06F 39/02* | (2006.01) |
| *D06F 105/50* | (2020.01) |
| *D06F 101/20* | (2020.01) |
| *D06F 101/14* | (2020.01) |
| *D06F 103/68* | (2020.01) |
| *D06F 103/38* | (2020.01) |
| *D06F 105/52* | (2020.01) |
| *D06F 105/56* | (2020.01) |
| *D06F 105/54* | (2020.01) |

(52) U.S. Cl.

CPC ..... *D06F 33/70* (2020.02); *D06F 33/72* (2020.02); *D06F 37/04* (2013.01); *D06F 37/22* (2013.01); *D06F 39/08* (2013.01); *D06F 39/083* (2013.01); *D06F 39/085* (2013.01); *D06F 39/088* (2013.01); *D06F 35/002* (2013.01); *D06F 35/005* (2013.01); *D06F 37/40* (2013.01); *D06F 39/00* (2013.01); *D06F 39/02* (2013.01); *D06F 2101/14* (2020.02); *D06F 2101/20* (2020.02); *D06F 2103/38* (2020.02); *D06F 2103/68* (2020.02); *D06F 2105/50* (2020.02); *D06F 2105/52* (2020.02); *D06F 2105/54* (2020.02); *D06F 2105/56* (2020.02); *D06F 2202/12* (2013.01); *D06F 2204/06* (2013.01); *D06F 2204/065* (2013.01); *D06F 2204/08* (2013.01); *D06F 2204/086* (2013.01); *D06F 2212/02* (2013.01); *D06F 2214/00* (2013.01); *D06F 2220/00* (2013.01); *D06F 2226/00* (2013.01)

(58) Field of Classification Search

CPC ..... D06F 33/46; D06F 33/68; D06F 33/70; D06F 33/72; D06F 37/04; D06F 37/22; D06F 37/40; D06F 39/00; D06F 35/005; D06F 2101/14; D06F 2101/20; D06F 2103/38; D06F 2103/68; D06F 2105/50; D06F 2105/52; D06F 2105/54; D06F 2105/56; D06F 2202/12; D06F 2204/06; D06F 2204/065; D06F 2204/08; D06F 2204/086; D06F 2212/02; D06F 2214/00; D06F 2220/00

See application file for complete search history.

(56) References Cited

U.S. PATENT DOCUMENTS

| | | | | |
|---|---|---|---|---|
| 2007/0151300 | A1* | 7/2007 | Sunshine | D06F 29/005 68/3 R |
| 2008/0022465 | A1 | 1/2008 | Jun et al. | |
| 2010/0269266 | A1 | 10/2010 | Lee et al. | |
| 2011/0016640 | A1* | 1/2011 | Kim | D06F 33/00 8/137 |
| 2011/0048079 | A1* | 3/2011 | Kim | D06F 37/42 68/13 R |
| 2011/0185511 | A1* | 8/2011 | Ryoo | D06F 39/088 8/137 |
| 2012/0047661 | A1 | 3/2012 | Hong et al. | |
| 2017/0335500 | A1* | 11/2017 | Li | D06F 29/005 |
| 2017/0342626 | A1* | 11/2017 | Li | D06F 39/04 |
| 2017/0342638 | A1* | 11/2017 | Lv | D06F 31/00 |

FOREIGN PATENT DOCUMENTS

| | | |
|---|---|---|
| KR | 10-2008-0010047 | 1/2008 |
| KR | 10-2010-0118227 | 11/2010 |
| KR | 10-2010-0120055 | 11/2010 |

* cited by examiner

DEVICE FOR HANDLING LAUNDRY, AND CONTROL METHOD THEREOF

CROSS-REFERENCE TO RELATED PATENT APPLICATIONS

This application is a U.S. National Stage Application under 35 U.S.C. § 371 of PCT Application No. PCT/KR2017/000988, filed Jan. 26, 2017, which claims priority to Korean Patent Application No. 10-2016-0010213, filed Jan. 27, 2016, whose entire disclosures are hereby incorporated by reference.

TECHNICAL FIELD

The present invention relates to a device for handling laundry having a plurality of washing units, and more particularly, to a device for handling laundry for controlling a plurality of washing units operating simultaneously, and a control method thereof.

BACKGROUND ART

Generally, a device for handling laundry is an apparatus that processes laundry through various operations such as washing, spin-dry and/or drying.

The device for handling laundry is an apparatus that supplies water to immerse the laundry, and dissolves an appropriate amount of the detergent in the wash water to remove the impurities from the laundry.

Such a device for handling laundry includes a device for handling laundry that washes laundry such as clothing or bedding by using the emulsifying action of the detergent, the water current action caused by the rotation of the tub or the laundry blade, and a mechanical force applied by the laundry blade, a dryer that applies a hot air or a cold air to dry the laundry, and a refresher that removes the crease of the clothes by applying steam. In addition, a washer-drier provides a combination of various functions.

A general device for handling laundry should be supplied with a minimum amount of wash water for performing washing. In the case where a tub having a large capacity is provided, there is a problem in that a large amount of wash water is required even when washing a small amount of laundry.

In response to this demand, a mini device for handling laundry for washing a small amount of laundry or a device for handling laundry for babies has been appeared. Further, there is a tendency to develop a device for handling laundry having a plurality of washing units having different capacities.

In the case of a device for handling laundry having a plurality of washing units, when the washing is simultaneously performed, the general washing processes are similar to each other and only differ in time, so that, in some cases, the plurality of washing units simultaneously perform the same operation.

In the case where the water supply is performed simultaneously, there is a limit on the amount of supplied water, so that the water supply may be delayed and a water supply error may occur. In the case where spin-dry is simultaneously progressed, vibration may occur heavily. Particularly, when resonance occurs in vibration between a plurality of washing units, there is a risk of damage to the device for handling laundry.

In addition, when drying or heating of the wash water is performed simultaneously, there is a problem that the power consumption of the device for handling laundry instantaneously increases rapidly.

DISCLOSURE

Technical Problem

It is an object of the present invention to provide a device for handling laundry and a control method thereof, and to provide a device for handling laundry for controlling the operation of each washing unit by combining washing courses of a plurality of washing units, when a plurality of washing units simultaneously operate in the device for handling laundry having a plurality of washing units performing washing independently of each other, and a control method thereof.

Technical Solution

In an aspect, there is provided a device for handling laundry including: a first washing unit having a first tub; and a second washing unit that has a second tub and which operates independently of the first washing unit; a first controller for controlling the first washing unit; and a second controller for controlling the second washing unit, wherein the first controller receives a second washing course of the second washing unit from the second controller when the first washing unit and the second washing unit operate simultaneously, and generates a third washing course configured to not perform a specific operation simultaneously based on a first washing course of the first washing unit and the second washing course and transmits the third washing course to the second controller and controls the first washing unit according to the third washing course.

The first controller classifies a plurality of partial processes included in the first washing course and the second washing course according to an operation and then, reconfigures the plurality of partial processes so that operations having a high power consumption are not overlapped with each other, and generates the third washing course which is a combination of the first washing course and the second washing course.

The first controller is configured to firstly perform a partial process of a washing unit having a start time that takes priority with respect to a partial process corresponding to the specific operation, among a plurality of partial processes included in the first washing course and the second washing course, and to delay operation of the partial process of other washing unit to set the third washing course.

The first controller sets the third washing course so as to perform a soaking process or a laundry untangling process during waiting due to an operation delay.

The first controller generates the third washing course by giving priority to a washing process as a first priority, a rinsing process as a second priority, a rinsing spin-dry process as a third priority, and a final spin-dry process as a fourth priority, with respect to the plurality of partial processes, and enabling an operation having a high-priority to be performed first.

The first controller generates the third washing course so that an operation of a washing course having a longer total washing time among the first washing course and the second washing course is performed first.

The first controller sets the third washing course so that the first washing unit and the second washing unit terminate simultaneously.

The first controller generates the third washing course so that water supply, spin-dry, drying operation, and operation according to wash water heating are not simultaneously performed.

The first controller generates the third washing course so that operations of drying and washing, wash water heating and washing, drying and rinsing, wash water heating and rinsing, drying and spin-dry, wash water heating and spin-dry, and spin-dry and spin-dry are not performed simultaneously in the first washing unit and the second washing unit.

The first controller generates the third washing course when the second washing course of the second washing unit is inputted within a certain time, after the first washing course is inputted.

The first controller generates the third washing course, when a new washing course is inputted to other washing unit, before one of the first washing unit and the second washing unit starts operation according to inputted washing course and an initial water supply is completed.

The device for handling laundry further includes an input unit having a twin washing key, and the first controller waits for a certain time when the twin washing key is inputted after inputting the first washing course, and generates the third washing course when the second washing course is inputted within the certain time.

When the second washing course is inputted and the twin washing key is inputted while the first washing unit operates according to the first washing course, the first controller combines remaining operation according to the first washing course with the second washing course to generate the third washing course.

When the first controller receives error information from the second controller while controlling the first washing unit according to the third washing course, the first controller ignores the third washing course and performs operation according to the first washing course.

In another aspect, there is provided a method for controlling a device for handling laundry comprising a first washing unit having a first tub, and a second washing unit that has a second tub and which operates independently of the first washing unit, the method including: inputting a first washing course to the first washing unit and inputting a second washing course to the second washing unit; generating a third washing course configured so that a specific operation is not simultaneously performed based on the first washing course and the second washing course, by a first controller of the first washing unit; and transmitting the third washing course to the second washing unit, and controlling the first washing unit according to the third washing course.

Generating a third washing course includes reconfiguring operations having a high power consumption not to be simultaneously performed in the first washing unit and the second washing unit, among a plurality of partial processes included in the first washing course and the second washing course, and generating the third washing course which is a combination of the first washing course and the second washing course.

Generating a third washing course includes setting the third washing course so that a partial process of a washing unit having a start time that takes priority is firstly performed with respect to a partial process corresponding to the specific operation among a plurality of partial processes included in the first washing course and the second washing course, and operation of a partial process of other washing unit is delayed.

Generating a third washing course includes setting the third washing course so that a soaking process or a laundry untangling process is performed for a waiting time due to an operation delay.

Generating a third washing course includes generating the third washing course so that a process of a washing course having a longer total washing time, among the first washing course and the second washing course, is performed first.

Generating a third washing course includes generating the third washing course so that water supply, spin-dry, drying operation, and operation according to wash water heating are not simultaneously performed.

Generating a third washing course includes generating the third washing course so that operations of drying and washing, wash water heating and washing, drying and rinsing, wash water heating and rinsing, drying and spin-dry, wash water heating and spin-dry, and spin-dry and spin-dry are not performed simultaneously in the first washing unit and the second washing unit.

The method further includes operating the first washing unit independently according to the first washing course; inputting the second washing course to the second washing unit, and inputting a provided twin washing key; and combining remaining operation of the first washing unit according to the first washing course with the second washing course to generate the third washing course.

The method further includes displaying information on the third washing course, and outputting a guide message on whether to apply the third washing course, when the third washing course is generated.

The method further includes ignoring the third washing course and performing operation according to an initial set washing course, when an error occurs in any one of the first washing unit and the second washing unit while the first washing unit and the second washing unit operate according to the third washing course.

Advantageous Effects

According to the device for handling laundry configured as described above and the control method of the present invention, when a plurality of washing units operating independently of each other simultaneously perform the washing process, the washing courses of the plurality of washing units are combined to change the washing course, and the plurality of washing units are controlled to perform a specific operation respectively according to the changed washing course, and thus, even when a plurality of washing units perform washing simultaneously, an operation of an error occurrence due to an operational delays, an operation of vibration occurrence, and an operation of requiring a high power consumption are not simultaneously performed in the plurality of washing units, so that it is possible to prevent the occurrence of errors due to the operational delays, to reduce the vibration, and to prevent the momentary increases in power consumption, thereby protecting the device for handling laundry and improving energy consumption efficiency.

MODE FOR INVENTION

Hereinafter, preferred embodiments of the present invention will be described with standard to the accompanying drawings. In describing the present embodiment, the same designations and the same standard numerals are used for the same components, and further description thereof will be omitted.

Figure 1:
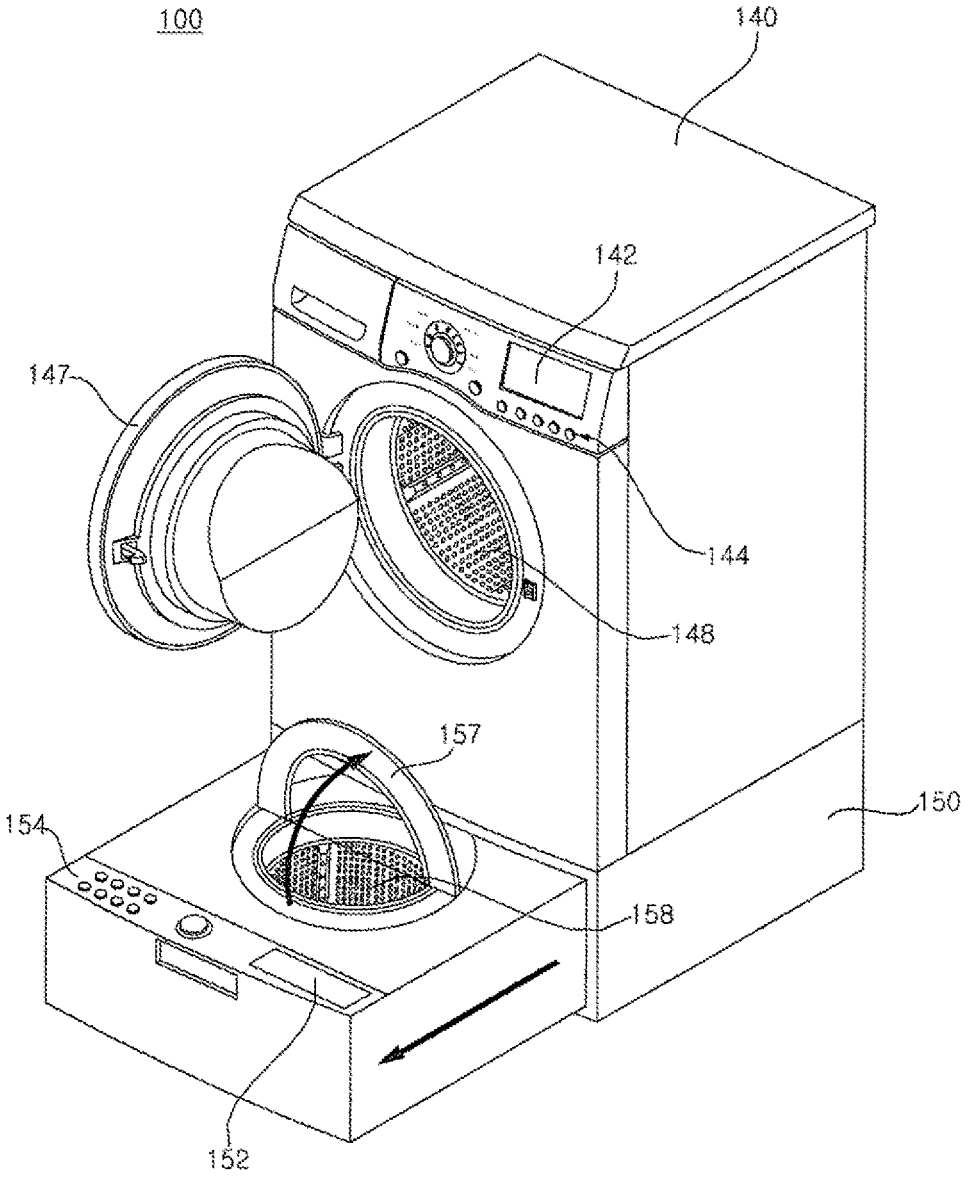
FIG. 1 is a perspective view illustrating a device for handling laundry according to an embodiment of the present invention.

FIG. 1 is a perspective view illustrating a device for handling laundry according to an embodiment of the present invention.

Referring to FIG. 1, a device for handling laundry 100 includes a first washing unit 140 and a second washing unit 150.

The first washing unit 140 and the second washing unit 150 are disposed vertically. The first washing unit 140 is disposed above the second washing unit 150, and the first washing unit 140 and the second washing unit 150 can be coupled to and separated from each other.

The first washing unit 140 is in the form of a front load device for handling laundry, and the second washing unit 150 is in the form of a top load device for handling laundry.

The second washing unit 150 has a structure in which it is slidably opened and closed in the front and rear direction like a drawer. When the second washing unit 150 is pulled to the front, the upper end of the second washing unit 150 is exposed. A second input unit 154, a second output unit 152, and a second door 157 are disposed in the upper end of the second washing unit 150.

The first washing unit 140 may include a first input unit 144, a first output unit 142 and a first door 147. The second washing unit 150 may include the second input unit 154, the second output unit 152, and the second door 157.

The first washing unit 140 and the second washing unit 150 are provided with separate input units 144 and 154 and output units 142 and 152, so that a command can be input independently of each other and an operation corresponding to the inputted command can be performed.

The first washing unit 140 and the second washing unit 150 may respectively include a water storage tank for containing water, a tub 148, 158 which accommodates laundry and is rotatably installed in the water storage tank, a motor for rotating the tub, a water supply device for supplying water into the water storage tank or the tub, and a draining device for draining water in the water storage tank, and perform washing independently of each other.

It is shown in the drawing that the capacity of the tub of the first washing unit 140 is larger than the capacity of the tub of the second washing unit 150. However, the capacity of the tub of the first washing unit 140 may be equal to or smaller than the capacity of the tub of the second washing unit 150. The tub capacity of each of the washing units 140 and 150 is not limited.

The first washing unit 140 and the second washing unit 150 may be a washer-drier for simultaneously providing a washing function and a drying function.

Figure 2:
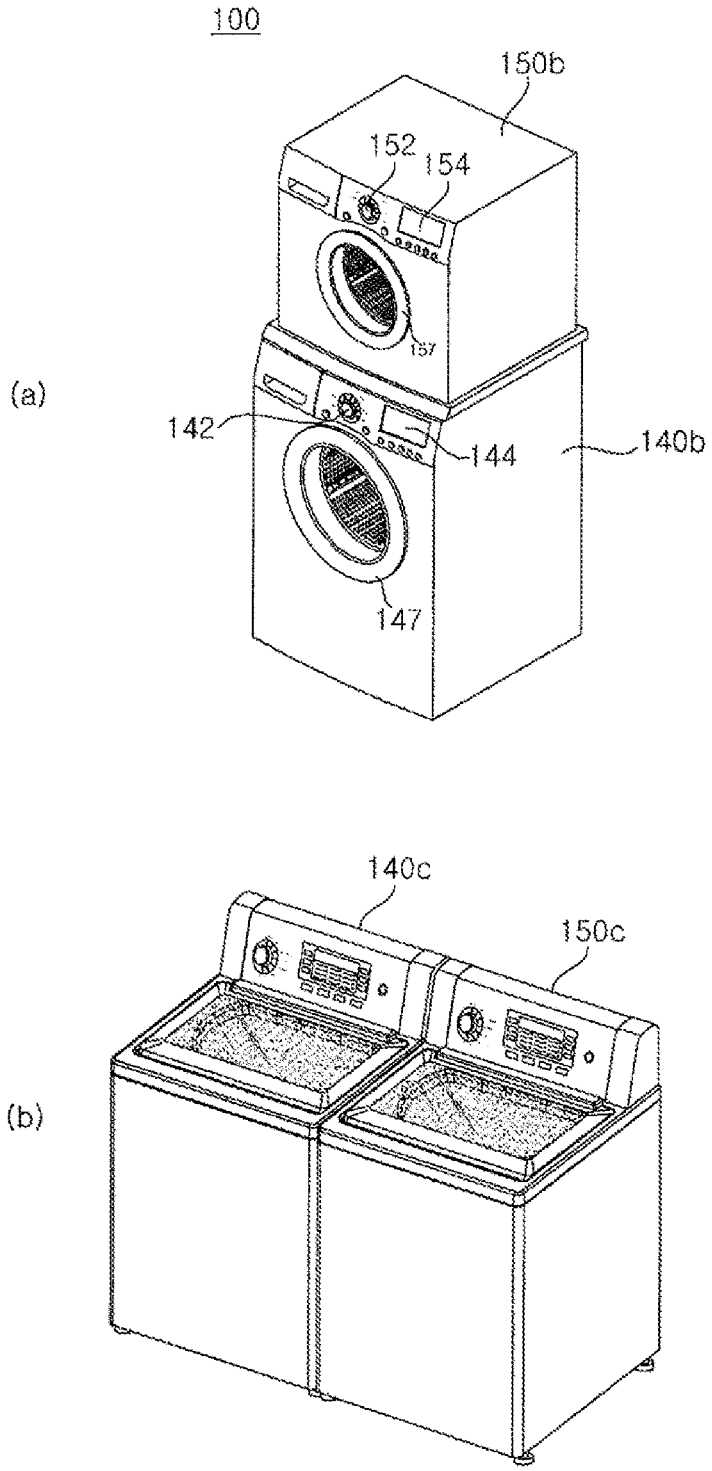
FIG. 2 is a perspective view illustrating a shape of a device for handling laundry according to another embodiment of the present invention.

FIG. 2 is a perspective view illustrating a shape of a device for handling laundry according to another embodiment of the present invention.

As shown in FIG. 2A, in the device for handling laundry, both the first washing unit 140*b* and the second washing unit 150*b* may be in the form of a front load device for handling laundry.

In addition, in the device for handling laundry, the second washing unit 150*b* may be disposed above the first washing unit 140*a*.

As shown in FIG. 2B, in the device for handling laundry, both the first washing unit 140*c* and the second washing unit 150*c* may be in the form of a top load device for handling laundry.

In addition, in the device for handling laundry, the first washing unit 140 and the second washing unit 150 may not be disposed vertically, but may be disposed laterally.

Hereinafter, the device for handling laundry will be illustrated that, as shown in FIG. 1, the first washing unit 140 and the second washing unit 150 are vertically disposed, but the disposition and form are not limited.

Figure 3:
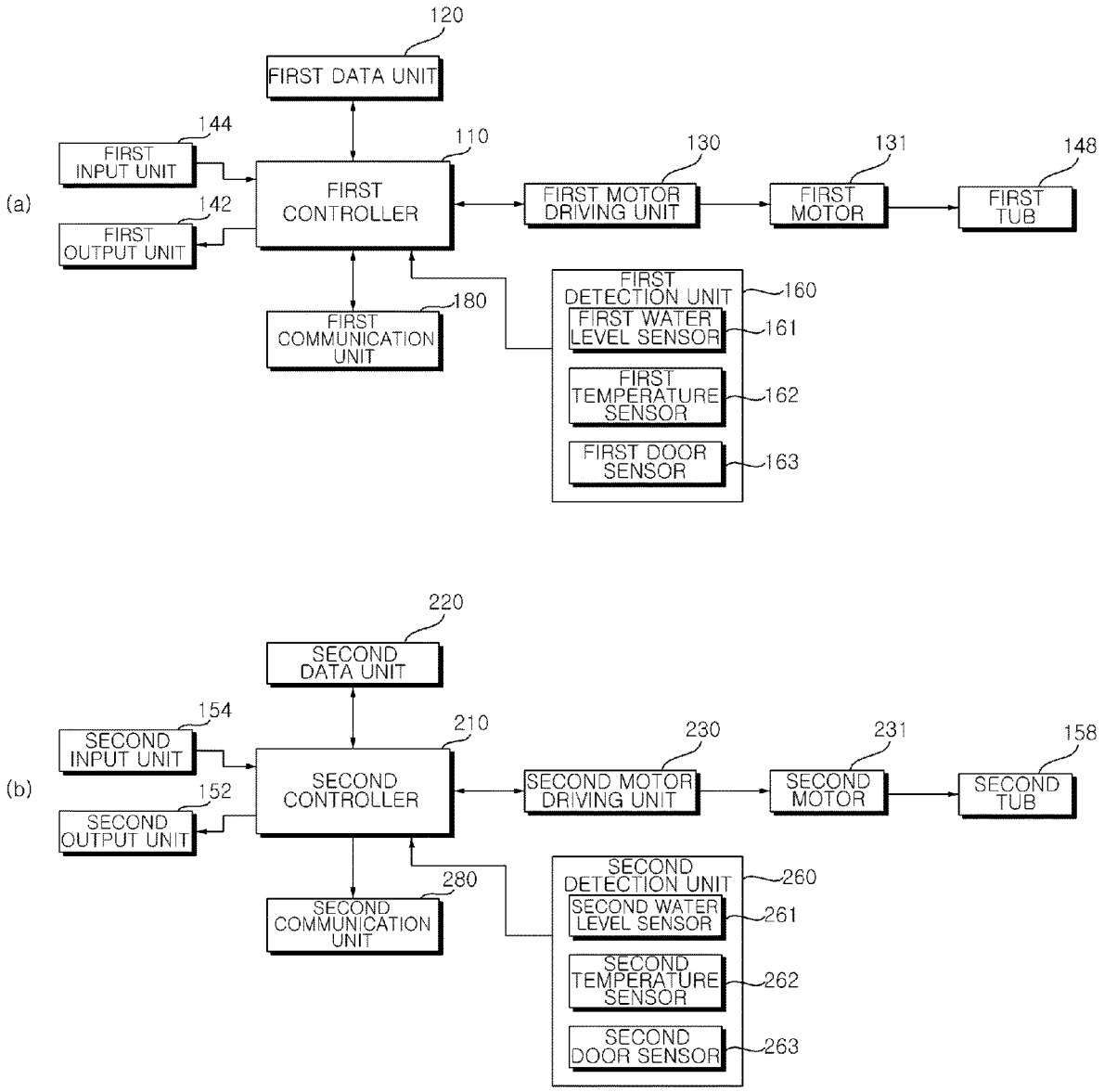
FIG. 3 is a block diagram illustrating a configuration of a first washing unit and a second washing unit of a device for handling laundry according to an embodiment of the present invention.

FIG. 3 is a block diagram illustrating a configuration of a first washing unit and a second washing unit of a device for handling laundry according to an embodiment of the present invention.

As shown in FIG. 3A, the first washing unit 140 includes a first input unit 144, a first output unit 142, a first tub 148, a first motor 131, a first motor driving unit 130, a first detection unit 160, a first heater controller 170, a first heater 171, a first communication unit 180, a first data unit 120, and a first controller 110 for controlling the overall operation of the first washing unit 140.

As shown in FIG. 3B, the second washing unit 150 includes a second input unit 154, a second output unit 152, a second tub 158, a second motor 231, a second motor driving unit 230, a second detection unit 260, a second heater controller 270, a second heater 271, a second communication unit 280, a second data unit 220, and a second controller 210 for controlling the overall operation of the second washing unit 150. At this time, the configuration of the second washing unit 150 is identically applied to the configuration of the first washing unit 140 described below in the operation of performing washing, and a description thereof will be omitted.

The first input unit 144 includes input means such as at least one button, a switch, and a touch pad, and inputs laundry setting such as a power input, a washing course, a water level, a temperature, and the like.

The first input unit 144 includes a twin washing key (not shown) for setting a twin washing mode so that the first washing unit and the second washing unit are operated by a new washing course which is formed by combining the washing courses of the first washing unit and the second washing unit. In addition, the first input unit 144 may include a progress key, a cancel key, or a simultaneous termination key. In this case, even when no separate twin washing key is provided, when at least two buttons among the plurality of provided buttons are operated at the same time, or when at least two buttons are operated in a specific order, the first input unit 144 inputs a signal according to the setting of twin washing mode to the first controller 110.

The first output unit 142 displays information on the washing setting inputted by the first input unit 144. The first output unit 142 includes a display unit for outputting an operation state of the first washing unit, and a lamp indicating a state of operation depending on whether the lamp is turned on or off, and includes a speaker, a buzzer, and the like for outputting a certain sound effect or a warning sound. The display unit displays the laundry setting and the operation state of the first washing unit on a screen in a combination of at least one of a character, an image, an icon, and a special character, and displays a notification according to the operation state.

The first data unit 120 stores control data for controlling the operation of the device for handling laundry, laundry setting data inputted, laundry time data calculated in accordance with the laundry setting, data about the washing course, and data for determining whether an error has occurred in the device for handling laundry. In addition, the first data unit 120 stores data detected or measured through the first detection unit 160 during operation of the device for handling laundry and data transmitted and received through the first communication unit 180. Particularly, data on the laundry time and the washing course received from the second communication unit can be stored in the first data unit 120.

The first communication unit 180 is connected to the second washing unit 150 in a wired or wireless manner to transmit and receive data. When washing starts in response to a control command of the first controller 110, when unusual occurs during washing, when the washing is terminated, the first communication unit 180 transmits/receives data on the laundry setting or operation state, or laundry time data to/from the second communication unit 280 of the second washing unit.

The first detection unit 160 includes a plurality of sensors to measure a voltage or a current of the device for handling laundry, and measures data such as temperature and water pressure and inputs the measured data to the first controller 110. At this time, the first detection unit 160 includes a first water level sensor 161 and a first temperature sensor 162. The first water level sensor 161 is installed in the first tub 148, and detects the water level of the wash water to input the water level data to the first controller 110. The first temperature sensor 162 measures the temperature of the wash water. A plurality of first temperature sensors 162 are installed in different positions, and detect the temperature of the heater to input the detected temperature to the first controller 110, when the first heater 171 for the temperature inside a control circuit, for heating or drying the wash water operates, in addition to the temperature of the wash water.

The first motor driving unit 130 supplies operating power to the first motor 131 connected to the first tub to rotate according to the control command of the first controller 110. The first motor driving unit 130 controls the rotation direction, the rotation angle, and the rotation speed of the first motor 131 according to the setting. The first motor driving unit 130 controls the first motor 131 to operate differently according to the set washing course, and the progressing washing, rinsing, and spin-dry.

At this time, the first motor driving unit 130 differently controls the rotation direction, the rotation angle, and the rotation speed of the first motor to form the water current of a specific type of the wash water in the first tub 148.

The first heater controller 170 controls the operation power supplied to the first heater 171 in response to the control command of the first controller 110 so that the first heater 171 can be operated or stopped. The first heater controller 170 controls the operation of the first heater by changing the number of the operating first heaters or varying the temperature of the first heater.

At least one first heater 171 may be provided to heat the wash water or generate heat during the drying operation. In the drying operation, the heater 171 generates heat, and the generated heat is circulated in the first tub 148 by a drying fan (not shown) to dry the laundry.

The first controller 110 controls a series of washing processes of washing, rinsing, spin-dry, and drying.

Hereinafter, it is specified that performing washing includes all operations including washing process, rinsing process, spin-dry process, and drying process.

The first controller 110 enables to perform water supply and drainage to the first tub 148 according to the operation setting inputted from the first input unit 144, and applies a control command to the first motor driving unit 130, so that the first tub 148 rotates according to the operation of the motor 131 to perform washing. In addition, the first controller 110 applies a control command to the heater controller 170 to operate the first heater 171 so that the wash water is heated or the drying operation is performed.

The first controller 110 stores the inputted operation setting in the first data unit 120, and outputs the operation setting or operation state through the first output unit 142. In addition, the first controller 110 transmits data on the first washing unit operation to the second washing unit through the first communication unit 180 during the first washing unit operation, and receives data of the second washing unit during the second washing unit operation and checks the operation of the second washing unit.

The first controller 110 determines whether the first and second washing units 140 and 150 operate simultaneously in response to the data of the received second washing unit 150, and generates a third washing course by combining a first washing course which is the washing course of the first washing unit with a second washing course which is the washing course of the second washing unit.

At this time, the first controller 110 sets a twin washing mode so that the first and second washing units operate according to the third washing course. The first controller 110 controls the first washing unit to operate according to the third washing course combining the first and second washing courses when the twin washing mode is set, and transmits data on the third washing course to the second washing unit so that the second washing unit also operates according to the third washing course. Accordingly, the second controller 210 controls the second washing unit according to the third washing course.

In this case, the third washing course is a combination of the first washing course and the second washing course, and is set such that the first and second washing units respectively perform the operations set at a specified time by changing a schedule for a partial process in order that a specific operation is not performed simultaneously in the first washing unit and the second washing unit.

When setting the twin washing mode and generating the third washing course, the first controller 110 classifies a plurality of partial processes included in the first washing course and the second washing course according to the operation, and then reconfigure the partial processes so that operations having a large power consumption are not overlapped with each other, thereby generating the third washing course.

For example, the first controller 110 generates the third washing course so that the operations according to water supply, spin-dry, drying operation, and wash water heating are not performed simultaneously in the first washing unit and the second washing unit. In addition, the first controller 110 can generate the third washing course so that the operations of drying and washing, wash water heating and washing, drying and rinsing, wash water heating and rinsing, drying and spin-dry, wash water heating and spin-dry, and spin-dry and spin-dry are not performed simultaneously in the first washing unit and the second washing unit.

The first controller 110 generates the third washing course so that the operation of the washing course having the longest total washing time among the first washing course and the second washing course is performed first.

At this time, when performing a partial process for a specific operation, the first controller 110 sets to firstly perform a partial process of the washing unit having a start time that takes priority on a partial process basis, and to delay the operation of the partial process of the other washing unit. In addition, with respect to a plurality of partial processes forming the washing course, the first controller 110 gives priority to the washing process as a first priority, the rinsing process as a second priority, the rinsing spin-dry process as a third priority, and the final spin-dry process as a fourth priority, and enables the operation having a high-priority to be performed first.

At this time, in the case of a washing unit which is delayed in operation and waiting, the first controller 110 may set to perform a soaking process or a laundry untangling process during waiting.

In addition, when the twin washing mode is set, the first controller may set the third washing course so that the first washing unit and the second washing unit terminate at the same time.

Meanwhile, when the first washing unit or the second washing unit performs the laundry untangling process, the creasing prevention process, and the cooling process for simultaneous termination, the first controller 110 may firstly terminate the operation of any one of the washing units in response to a key input of the first input unit 144.

When setting the twin washing mode, when the second washing course is inputted from the second washing unit within a certain time after inputting the first washing course, the first controller 110 sets the twin washing mode and generates the third washing course.

For example, when the first washing unit is operating in a specified washing course according to the inputted setting, if a new washing course is inputted to the second washing unit before the initial water supply is completed, the first controller 110 generates the third washing course.

In addition, when a twin washing key of the first input unit 144 is inputted, the first controller 110 waits for a certain time until the second washing course is inputted, after the first washing course is inputted, to generate the third washing course.

When the second washing course is inputted and the twin washing key is inputted while the first washing unit is operating according to the first washing course, the first controller 110 combines the remaining operation according to the first washing course with the second washing course to generate the third washing course.

When the twin washing mode is set as described above, the first controller 110 outputs a notification of the mode setting and information on the third washing course through the display unit of the first output unit 142. In addition, the first controller 110 may output a guide message, through the first output unit 142, on whether to apply the third washing course generated by combining the first and second washing courses. At this time, the first controller 110 may operate by applying the third washing course according to the input of the progress key or the cancel key of the first input unit 144, or may cancel the twin washing mode.

Meanwhile, when an error occurs, during operation according to the third washing course, the first controller 110 cancels the twin washing mode and transmits data about the cancel of twin washing mode to the second washing unit. Accordingly, the second controller 210 ignores the third washing course and performs washing according to the existing second washing course with respect to the remaining operation. In addition, when an error occurs in the second washing unit, the first controller 110 cancels the twin washing mode and performs the remaining operation according to the first washing course.

The second controller 210 also can change or set the washing course as described above. When the twin washing mode is set, the second controller 210 can control the operation of the second washing unit according to the third washing course, and outputs information on the twin washing mode and the third washing course through the provided second output unit 152.

Figure 4:
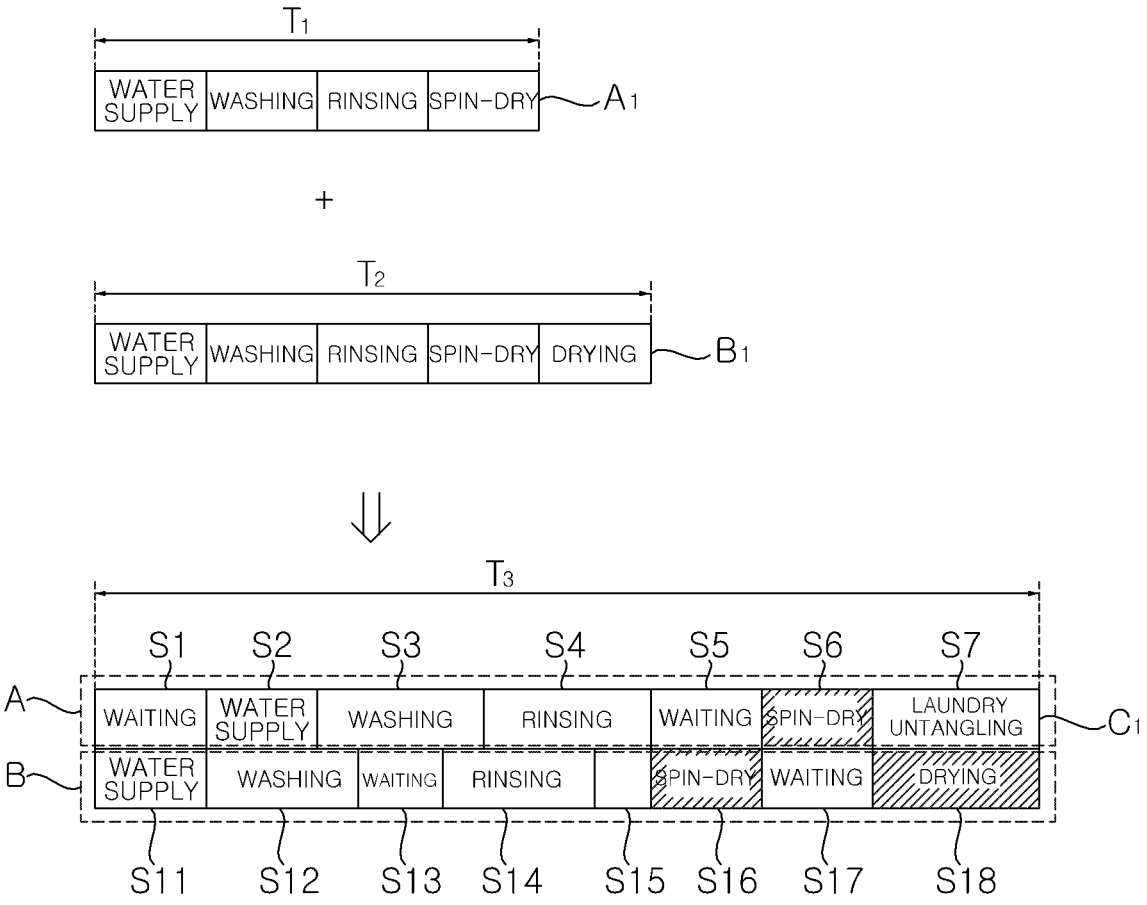
FIG. 4 is an exemplary diagram for explaining a washing course generated by combining washing courses, in a device for handling laundry according to an embodiment of the present invention.

FIG. 4 is an exemplary diagram for explaining a washing course generated by combining washing courses, in a device for handling laundry according to an embodiment of the present invention.

As shown in FIG. 4, when the twin washing mode is set, the first controller 110 combines a first washing course A1 and a second washing course B1 to generate a third washing course C1.

The first washing course A1 is formed by partial processes of water supply, washing, rinsing, and spin-dry to set a first washing time T1, and the second washing course B1 is formed by partial processes of water supply, washing, rinsing, spin-dry, and drying to set a second washing time T2.

At this time, the first controller 110 generates the third washing course C1 so that the second washing course B1, which has a longer washing time among the first washing course A1 and the second washing course B1, starts operation firstly.

In addition, the first controller 110 changes the water supply to the first and second washing units so as not to be simultaneously performed, and also sets the spin-dry not to be simultaneously performed in the first and second washing units. In addition, with respect to each partial process, the first controller 110 sets the third washing course so that the drying and washing, the wash water heating and washing, the drying and rinsing, the wash water heating and rinsing, the drying and spin-dry, the wash water heating and spin-dry, and the spin-dry and spin-dry are not to be simultaneously performed in the first washing unit and the second washing unit.

As the third washing course C1 is generated, the first controller 110 performs the washing course A for the first washing unit 140 during the third washing course C1, and the second controller 110 performs operation according to the washing course B for the second washing unit 150 during the third washing course C1.

During the water supply of the second washing unit 150 (S11), the first washing unit 140 waits (S1), when the water supply of the second washing unit 150 is completed and the washing process is started (S12), the water supply of the first washing unit 140 is performed (S2). After the completion of the water supply, the first washing unit 140 performs a washing process (S3), and the second washing unit 150 performs a rinsing process (S14) after waiting (S13). The first washing unit 140 also performs a rinsing process (S4), and the second washing unit 150 starts spin-dry (S16) when the rinsing process of the first washing unit 140 is completed. The first washing unit 140 waits until the spin-dry of the second washing unit 150 is completed (S5), and then performs spin-dry (S6). Meanwhile, the second washing unit 150 waits during the spin-dry of the first washing unit 140 (S17), and then performs drying (S18). The first washing unit 140 terminates the washing by the spin-dry, but performs a laundry untangling process while the second washing unit performs drying so that the first washing unit and the second washing unit are simultaneously terminated (S7). Accordingly, during a total third washing time T3, the first washing unit and the second washing unit perform washing based on the third washing course.

The washing time is increased in comparison with the respective washing times T1 and T2 for the first washing course A1 and the second washing course B1, but the first washing unit and the second washing unit can be washed simultaneously and, further, can be terminated simultaneously, so that the laundry can be recovered at time.

Figure 5:
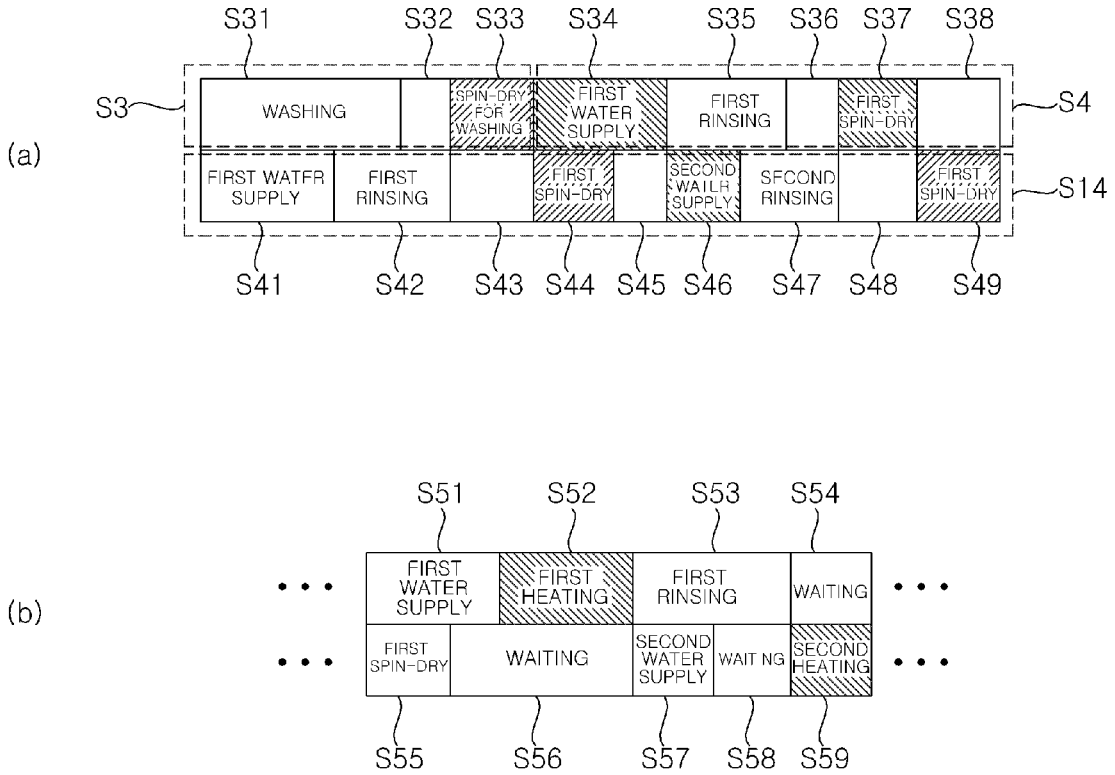
FIG. 5 is an exemplary diagram for explaining a partial process included in the changed washing course of FIG. 4.

FIG. 5 is an exemplary diagram for explaining a partial process included in the changed washing course of FIG. 4.

When the first washing unit 140 and the second washing unit 150 perform washing according to the third washing course, the first washing unit and the second washing unit simultaneously or separately perform also the partial included in the washing, rinsing, and spin-dry.

As shown in FIG. 5A, while the first washing unit 140 performs a washing process (S3), the second washing unit 150 starts a rinsing process (S14). After a certain time, the washing unit 140 also starts a rinsing process (S4).

At this time, as for the rinsing process, the rinsing process is formed of partial processes of water supply, rinsing, and spin-dry, and such a partial process is repeatedly performed depending on the number of times of rinsing. The washing process can also be divided into the washing and the spin-dry for washing. Here, the description of the draining is omitted in the following.

During the washing operation of the first washing unit 140 (S31), the second washing unit 150 performs a first water supply (S41) and then performs a first rinsing (S42), during the rinsing process. At this time, the first washing unit 140 waits for a certain time (S32) after washing (S31), and then performs the spin-dry for washing (S33).

After the first rinsing, waiting (S43) is accomplished until the spin-dry for washing (S32) of the first washing unit 150 is terminated, and when the spin-dry for washing is completed, a first spin-dry for rinsing (S44) is performed. The first washing unit 140 performs a first rinsing (S35) after a first water supply (S34) while starting the rinsing process. Before starting the second water supply after the first spin-dry, the second washing unit 150 waits (S45) until the first water supply of the first washing unit 140 is completed, and then performs the second water supply (S46) and performs a second rinsing (S47). The first washing unit 140 waits (S36) after the first rinsing, and then performs a first spin-dry (S37). After waiting (S48), the second washing unit 150 performs a second spin-dry (S49) when the first spin-dry (S37) of the first washing unit is terminated.

As shown in FIG. 5B, when performing the rinsing process, in the case where the first washing unit and the second washing unit perform heating (wash water heating) by using the heater 171, 271, the first controller 110 and the second controller 210 enable the heating not to be simultaneously performed according to the third washing course, and enable also the heating and the spin-dry not to be simultaneously performed.

Accordingly, when the first washing unit 140 performs a first heating (S52) after a first water supply (S51), the second washing unit 150 waits (S56) during the first heating (S52) after a first spin-dry (S55). The second washing unit 150 performs a second water supply S57 after the first heating S52 is completed. After waiting for a certain time (S58), when a first rinsing S53 of the first washing unit 140 is terminated, the second washing unit 150 performs a second heating (S59). The first washing unit 140 waits (S54) during the second heating (S59) of the second washing unit.

At this time, although the first controller 110 and the second controller 210 can transmit and receive data during operation, the first controller 110 and the second controller 210 do not perform communication for all operations, but control the operation as described above according to the generated third washing course.

As described above, when the first washing unit 140 and the second washing unit 150 perform the processes of washing, rinsing, spin-dry, and drying according to the third washing course, the first controller 110 generates the third washing course so that a specific operation is not performed simultaneously also in each partial process.

Figure 6:
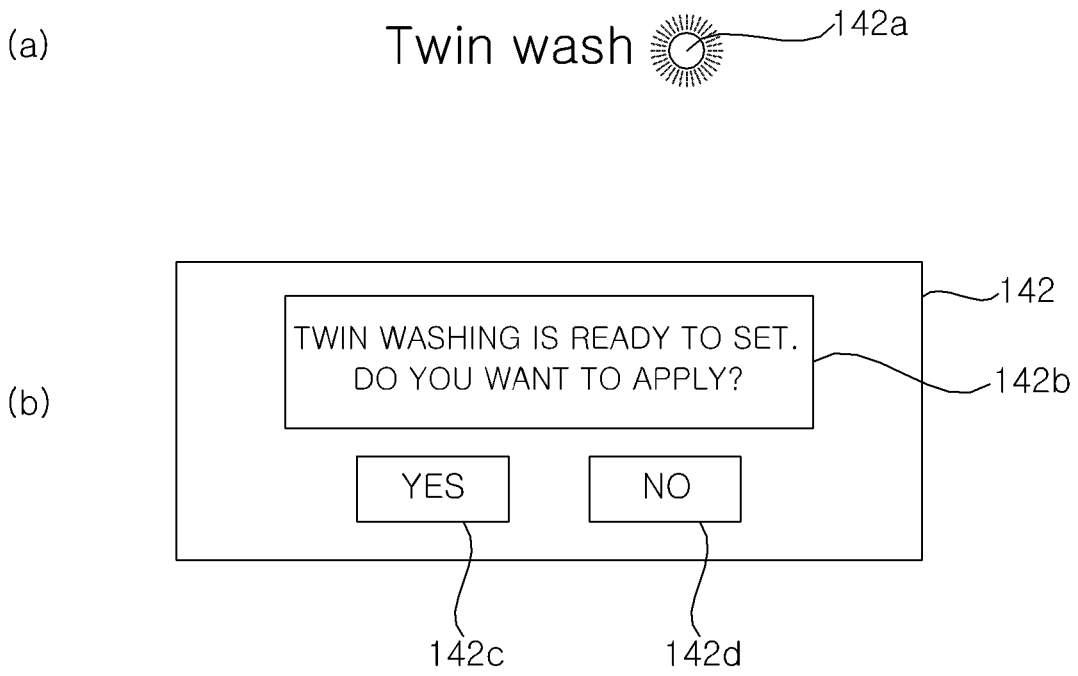
FIG. 6 is a diagram illustrating an example of a notification indicating that washing is simultaneously performed, in a device for handling laundry according to an embodiment of the present invention.

FIG. 6 is a diagram illustrating an example of a notification indicating that washing is simultaneously performed, in a device for handling laundry according to an embodiment of the present invention.

The first output unit 142 or the second output unit 152 outputs a notification according to the twin washing mode setting as shown in FIGS. 6A and 6B.

As shown in FIG. 6A, when a lamp 142*a* is provided in the output unit, it is possible to indicate that the twin washing mode is set by turning on the lamp.

In addition, when a display unit is provided in the output unit 142 as shown in FIG. 6B, a notification or a guide message 142*b* according to the twin washing mode setting is outputted. At this time, the progress key 142*c* and the cancel key 142*d* may be displayed concerning whether the twin washing mode is applied. When the display unit is a touch screen, it can be operated as an input unit. When the display unit is not a touch screen, a twin washing mode can be applied according to the input of a progress key and a cancel key separately provided.

Figure 7:
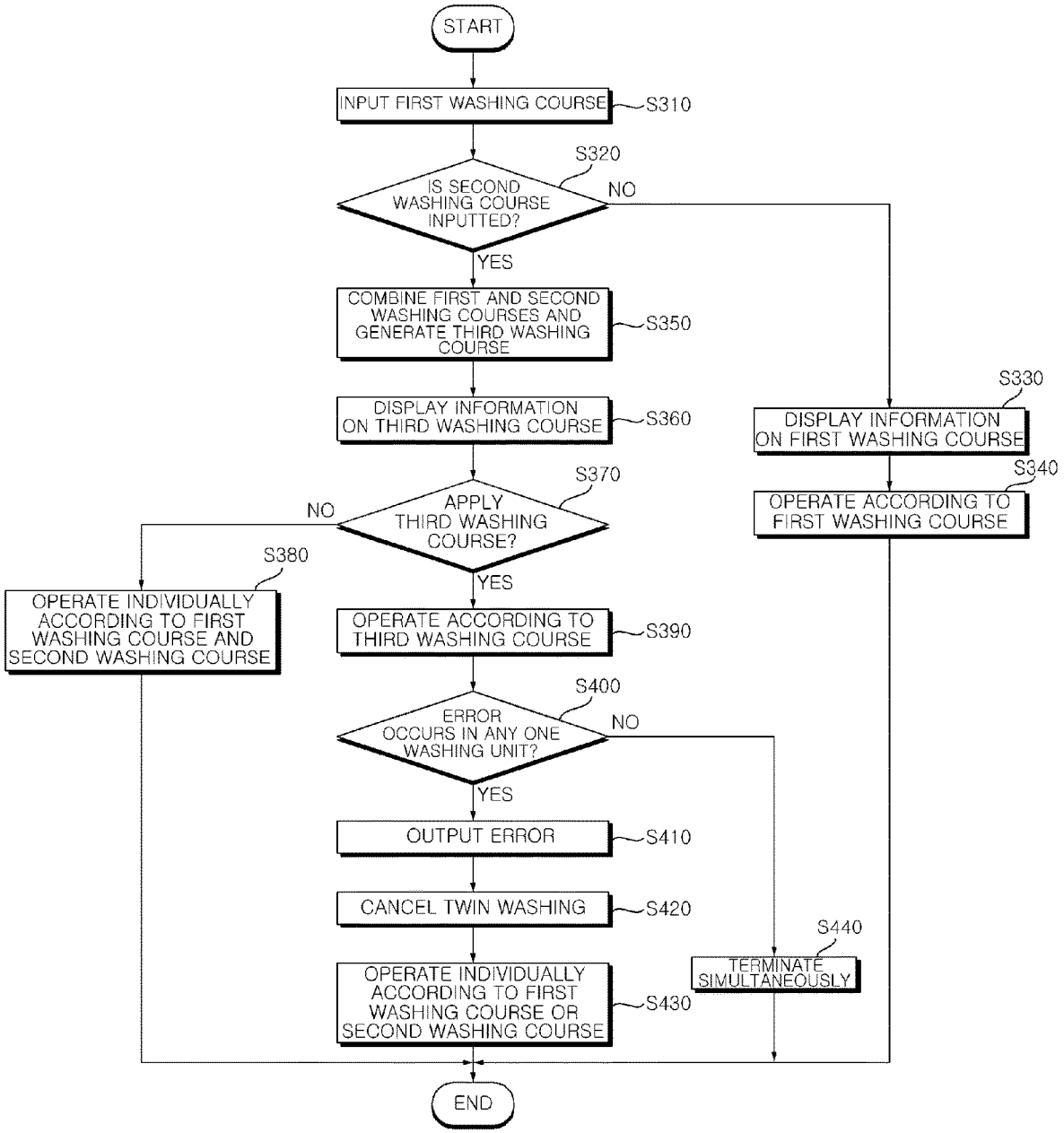
FIG. 7 is a flowchart illustrating a method of changing a washing course of a device for handling laundry according to an embodiment of the present invention.

FIG. 7 is a flowchart illustrating a method of changing a washing course of a device for handling laundry according to an embodiment of the present invention.

As shown in FIG. 7, the first washing course for the first washing unit 140 is inputted through the first input unit 144.

The first controller 110 transmits and receives data to and from the second washing unit through the first communication unit 180 and determines whether a second washing course is inputted to the second washing unit 150 (S320). When the second washing course is inputted to the second washing unit 150, the second controller 210 transmits the data on the inputted washing course to the first washing unit 140 through the second communication unit 280.

When the second washing course is not inputted, the first controller 110 displays information on the inputted first washing course and the washing time through the first output unit 142 (S330). During the progress of washing, the first output unit 142 outputs information on the operating state.

The first controller 110 controls the first washing unit 140 to perform washing according to the first washing course so that the first washing unit 140 performs washing according to the first washing course (S340).

Meanwhile, when the second washing course is inputted, the first controller 110 sets the twin washing mode, and combines the first washing course and the second washing course to generate the third washing course (S350).

When the first washing unit and the second washing unit operate simultaneously, the first controller 110 enables a specific operation such as water supply, spin-dry, heating, and drying not to be performed simultaneously, and sets the third washing course so that the spin-dry and heating/drying, and the heating and drying are not to be simultaneously performed. The first controller 110 sets the third washing course by previously specifying a schedule for partial process included in each process, in addition to the setting for washing, rinsing, spin-dry, and drying. As described above, the first controller 110 may delay any single operation or add a certain operation by setting a specific operation not to be performed simultaneously.

The first controller 110 displays information on the third washing course generated through the first output unit 142 (S360).

At this time, the first output unit 142 displays the third washing course and the washing time for the third washing course according to the control command of the first controller, and displays the notification according to the twin washing mode setting.

In addition, the first output unit 142 outputs a guide message on whether to apply the third washing course. At this time, when the guide message is outputted, the progressing or the canceling of twin washing mode is inputted from the first input unit 144 in response to the guide message.

When the third washing course is not applied or when the canceling of the twin washing mode is selected, the first controller 110 cancels the twin washing mode and controls the first washing unit to operate according to the first washing course, and transmits data on the cancel of twin washing mode to the second washing unit 150. The second controller 210 controls the second washing unit to operate according to the second washing course.

Accordingly, the first washing unit and the second washing unit individually perform washing according to the first washing course and the second washing course, respectively (S380).

At this time, when the third washing course is selected to be applied, the first controller 110 controls the first washing unit to operate according to the third washing course, and transmits data on the third washing course to the second washing unit. The second controller 210 controls the second washing unit according to the received third washing course. In addition, after the information on the third washing course is outputted, when there is no input through the input unit within a certain time, the first controller 110 enables to operate according to the third washing course.

Accordingly, the first washing unit and the second washing unit respectively perform washing according to the third washing course (S390).

As described in FIG. 4, the first washing unit operates according to the washing course A for the first washing unit during the third washing course C1, and the second washing unit operates according to the washing course B for the second washing unit during the third washing course C1.

If an error occurs in any one of the washing units while the first washing unit 140 and the second washing unit 150 are operated according to the third washing course (S400), for example, if an error occurs in the first washing unit, the first controller 110 outputs an error through the first output unit 142 (S410).

In addition, the first controller 110 cancels the twin washing mode and transmits data on the cancel of twin washing mode to the second washing unit 150 so that the first washing unit and the second washing unit operate individually (S430).

At this time, the first controller 110 determines whether the first washing unit is operable, controls the remaining operation to operate according to the first washing course if the operation is possible, and stops the operation if the operation is impossible. Meanwhile, the second controller 210 ignores the third washing course with respect to the remaining operation, and performs the individual operation according to the second washing course.

Meanwhile, if no additional error occurs, the first and second washing units perform washing according to the third washing course, and terminated simultaneously (S440).

Figure 8:
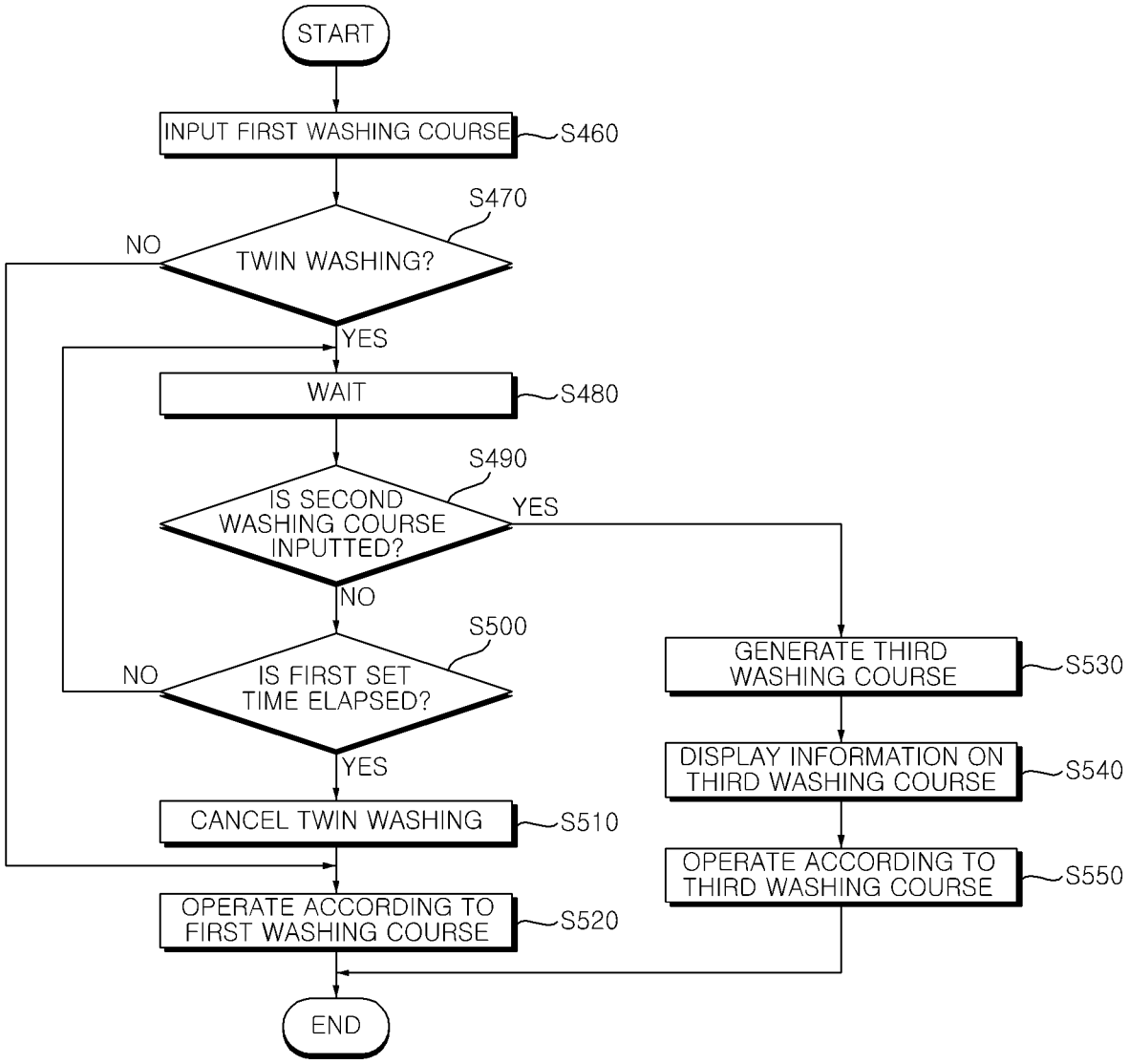
FIG. 8 is a flowchart illustrating a method of changing a washing course according to a mode setting of a device for handling laundry according to an embodiment of the present invention.

FIG. 8 is a flowchart illustrating a method of changing a washing course according to a mode setting of a device for handling laundry according to an embodiment of the present invention.

As shown in FIG. 8, a first washing course is inputted to the first washing unit 140 (S460), and a washing setting for the first washing unit is inputted.

When the provided twin washing key is inputted to the first input unit 144 (S470), the first controller 110 waits until the washing course is inputted from the second washing unit 150 (S480).

If there is no additional twin washing key input, the first controller 110 controls the first washing unit 140 to operate according to the inputted first washing course (S520).

After the twin washing key is inputted, the first controller 110 determines whether a washing course is inputted within a first set time from the second washing unit 150 (S490).

If the first set time is elapsed during waiting without inputting the second washing course (S500), the first controller 110 cancels the twin washing mode (S510).

The first controller 110 controls the first washing unit 140 to operate according to the inputted first washing course (S520).

Meanwhile, when the second washing course is inputted within the first set time after the input of the twin washing key (S490), the first controller 110 combines the first washing course and the second washing course to generate the third washing course (S530).

The first controller 110 displays information on the third washing course and a notification of the twin washing mode through the first output unit 142 (S540). The first output unit 142 displays the notification indicating that the twin washing mode is set, and the information on the third washing course. In some cases, the first output unit 142 may display a guide message on whether to apply the third washing course.

The first controller 110 controls the first washing unit to operate according to the third washing course, and transmits data on the third washing course to the second washing unit so that the second washing unit operates according to the third washing course (S550).

Accordingly, the first washing unit and the second washing unit operate according to the third washing course, and terminate operation simultaneously.

Figure 9:
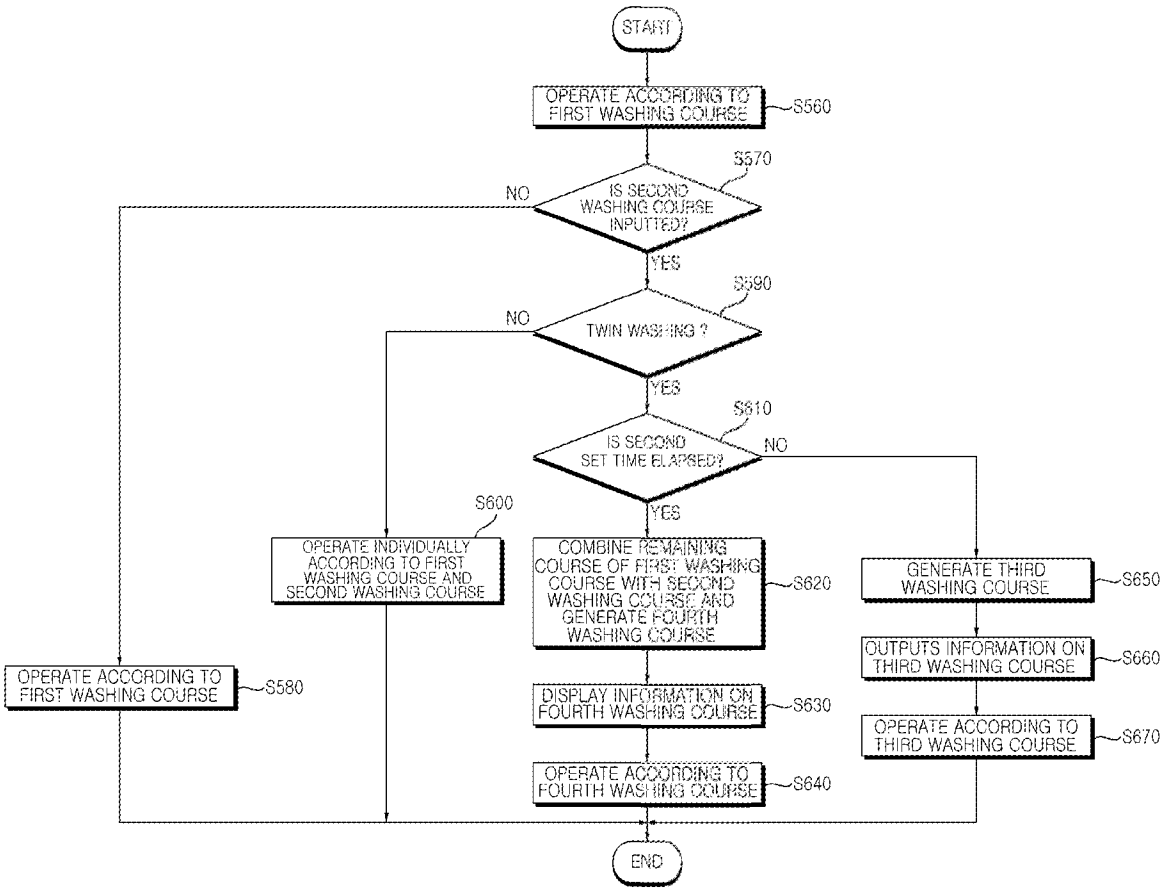
FIG. 9 is a flowchart illustrating a method for changing a washing course during operation of any one washing unit of a device for handling laundry according to an embodiment of the present invention.

FIG. 9 is a flowchart illustrating a method for changing a washing course during operation of any one washing unit of a device for handling laundry according to an embodiment of the present invention.

As shown in FIG. 9, the first washing unit 140 performs an operation based on the inputted first washing course (S560).

If there is no input of the second washing course of the second washing unit during operation of the first washing unit, the first washing unit operates independently according to the first washing course (S580).

Meanwhile, when the second washing course is inputted to the second washing unit 150 while the first washing unit 140 performs washing (S570), the first controller 110 determines whether the twin washing mode is set (S590).

The first controller 110 can determine as the twin washing mode, when the twin washing key is inputted through the first input unit 144 or when the twin washing key is inputted through the second input unit 154 of the second washing unit.

In some cases, the first controller 110 may output a guide message indicating whether to set the twin washing mode through the first output unit 142 so that the twin washing mode can be set in response to the user input for the guide message. At this time, the guide message may be outputted to the second output unit 152 of the second washing unit to which the second washing course is inputted. The second controller 110 outputs the guide message on whether to apply the twin washing mode when the second washing course is inputted, and transmits data on the twin washing mode setting to the first washing unit when the twin washing mode is applied.

In addition, when the twin washing mode is set to be automatically applied according to the setting, when the first washing unit and the second washing unit operate simultaneously without a separate input, the first controller 110 can set the twin washing mode.

When the twin washing mode is not set, the first controller 110 enables the first washing unit to operate according to the first washing course, and enables the second washing unit to operate individually according to the second washing course (S600).

When the twin washing mode is set (S590), the first controller 110 compares the degree of operation progress of the first washing unit or the elapsed washing time of the first washing unit with a second set time (S610).

When the elapsed washing time of the first washing unit is equal to or longer than the second set time, the first controller 110 combines the remaining course of the first washing course with the second washing course to generate a fourth washing course (S620).

The fourth washing course is a combination of the remaining process with the second washing course, except for the process already completed in the first washing course, and the washing course setting method of the fourth washing course is the same as the third washing course setting method.

When the fourth washing course is set, the first controller 110 outputs information on the fourth washing course through the first output unit 142 (S630).

The first controller 110 transmits data on the fourth washing course to the second washing unit 150, and controls the first washing unit to perform operation according to the fourth washing course (S640).

At this time, the first controller 110 enables to output a guide message on whether to apply the fourth washing course together with the information on the fourth washing course, and applies or cancels the fourth washing course in response to a user command inputted for the guide message.

In addition, when generating the fourth washing course, if a difference between the washing time for the remaining course of the first washing course and the washing time for the second washing course is equal to or greater than a certain value, the first controller 110 may cancel the fourth twin washing, and set to operate individually. For example, since the time difference with the washing time of the second washing course is large when the first washing course leaves only the spin-dry process, the first control unit 110 can cancel the twin washing mode and control the first and second washing units to operate individually.

Meanwhile, when the twin washing mode is set and the elapsed washing time of the first washing unit is less than the second set time, the first controller 110 sets the third washing course by combining the first washing course and the second washing course (S650). The third washing course may be set by reconfiguring each washing course so that specific operations are not performed simultaneously as described above.

For example, when the first washing unit is performing water supply, or when the water supply is completed and the washing is started, the first controller 110 may generate the third washing course.

The first controller 110 outputs information on the third washing course through the first output unit 142 (S660), controls the operation so that the first washing unit operates according to the third washing course (S670), and transmits the information on the third washing course to the second washing unit so that the second washing unit operates according to the third washing course (S670).

Therefore, according to the present invention, in the first washing unit and the second washing unit independently performing washing, when the first washing unit and the second washing unit operate simultaneously, the washing courses of the first washing unit and the second washing unit are combined so that the first washing unit and the second washing unit are operated according to a new washing course. At this time, according to the present invention, a specific operation such as water supply, spin-dry, heating, and drying are not performed simultaneously in the first washing unit and the second washing unit by delaying a certain operation or adding an operation to reconfigure the washing course. Accordingly, the occurrence of vibration and the increase of power consumption due to the simultaneous operation can be prevented, and the first washing unit and the second washing unit can be simultaneously terminated, thereby facilitating the recovery of laundry.

Although the exemplary embodiments of the present invention have been disclosed for illustrative purposes, those skilled in the art will appreciate that various modifications, additions and substitutions are possible, without departing from the scope and spirit of the invention as disclosed in the accompanying claims. Accordingly, the scope of the present invention is not construed as being limited to the described embodiments but is defined by the appended claims as well as equivalents thereto.

The invention claimed is:

1. A device for handling laundry comprising:

a first washing unit that includes a first tub and a first communication unit; and a second washing unit that includes a second tub and a second communication unit, and which operates independently of the first washing unit;

a first controller for controlling the first washing unit; and a second controller for controlling the second washing unit, wherein the first controller receives data on a second washing course of the second washing unit from the second controller through the first and the second communication units when the first washing unit and the second washing unit operate simultaneously, and generates a third washing course configured to not perform a specific operation simultaneously based on a first washing course of the first washing unit and the second washing course of the second washing unit and transmits data on the third washing course to the second controller through the first and the second communication units and controls the first washing unit according to the third washing course, wherein the third washing course is a combination of the first washing course and the second washing course and is set such that the first and the second washing units respectively perform set operations, wherein the first controller generates the third washing course so that water supply, spin-dry, drying operation, and operation according to wash water heating are not simultaneously performed.

2. The device for handling laundry of claim 1, wherein the first controller classifies a plurality of partial processes included in the first washing course and the second washing course, and then reconfigures the plurality of partial processes so that operations having a high power consumption are not overlapped with each other, and generates the third washing course which is a combination of the first washing course and the second washing course.

3. The device for handling laundry of claim 1, wherein the first controller is configured to firstly perform a partial process of one washing unit, among the first washing unit and the second washing unit, having a start time that takes priority with respect to a partial process corresponding to the specific operation, among a plurality of partial processes included in the first washing course and the second washing course, and to delay operation of the partial process of another one washing unit among the first washing unit and the second washing unit, to set the third washing course.

4. The device for handling laundry of claim 3, wherein the first controller sets the third washing course so as to perform a soaking process or a laundry untangling process during waiting due to an operation delay.

5. The device for handling laundry of claim 4, wherein the first controller generates the third washing course by giving priority to a washing process as a first priority, a rinsing process as a second priority, a rinsing spin-dry process as a third priority, and a final spin-dry process as a fourth priority, with respect to the plurality of partial processes, and enabling an operation having a high-priority to be performed first.

6. The device for handling laundry of claim 1, wherein the first controller generates the third washing course so that an operation of a washing course having a longer total washing time, among the first washing course and the second washing course, is performed first.

7. The device for handling laundry of claim 1, wherein the first controller sets the third washing course so that the first washing unit and the second washing unit terminate simultaneously.

8. The device for handling laundry of claim 1, wherein the first controller generates the third washing course so that operations of drying and washing, wash water heating and washing, drying and rinsing, wash water heating and rinsing, drying and spin-dry, wash water heating and spin-dry, and spin-dry and spin-dry are not performed simultaneously in the first washing unit and the second washing unit.

9. The device for handling laundry of claim 1, wherein the first controller generates the third washing course when the second washing course of the second washing unit is inputted within a certain time, after the first washing course is inputted.

10. The device for handling laundry of claim 1, wherein the first controller generates the third washing course, when a new washing course is inputted to another washing unit, among the first washing unit and the second washing unit, before one washing unit, among the first washing unit and the second washing unit starts operation according to inputted washing course and an initial water supply is completed.

11. The device for handling laundry of claim 1, further comprising an input unit having a twin washing key, wherein the first controller waits for a certain time when the twin washing key is inputted after inputting the first washing course, and generates the third washing course when the second washing course is inputted within the certain time.

12. The device for handling laundry of claim 11, wherein, when the second washing course is inputted and the twin washing key is inputted while the first washing unit operates according to the first washing course, the first controller combines remaining operation according to the first washing course with the second washing course to generate the third washing course.

13. The device for handling laundry of claim 1, further comprising:

a first display unit for outputting an operation state of the first washing unit and the first washing course or the third washing course; and a second display unit for outputting an operation state of the second washing unit and the second washing course or the third washing course.

14. The device for handling laundry of claim 13, wherein the first display unit and the second display unit output a guide message on whether to apply the third washing course when the third washing course is generated.

15. The device for handling laundry of claim 1, wherein, when the first controller receives error information from the second controller while controlling the first washing unit according to the third washing course, the first controller ignores the third washing course and performs operation according to the first washing course.

16. The device for handling laundry of claim 1, wherein, when the second controller receives error information from the first controller while controlling the second washing unit according to the third washing course, the second controller ignores the third washing course and performs operation according to the second washing course.

* * * * *